United States Patent [19]

Cherbonnier

[11] Patent Number: 4,883,388

[45] **Date of Patent: * Nov. 28, 1989**

[54] LOAD COMPENSATING SYSTEM

[76] Inventor: T. Dave Cherbonnier, 57 Kheam Hock Rd., Singapore, Hong Kong, 1129

[ * ] Notice: The portion of the term of this patent subsequent to May 5, 2004 has been disclaimed.

[21] Appl. No.: 35,784

[22] Filed: Apr. 8, 1987

Related U.S. Application Data

[63] Continuation-in-part of Ser. No. 783,679, Oct. 3, 1985, Pat. No. 4,662,786.

[51] Int. Cl.[4] ..... E21B 7/12; E21B 19/09

[52] U.S. Cl. ..... 405/195; 114/264; 166/355; 175/5; 267/160

[58] Field of Search ..... 405/148, 195, 196, 202, 405/205, 211, 212, 214, 215, 224, 290, 291, 296; 114/264, 265; 166/350, 355, 359, 367; 175/5, 7; 188/266; 248/588; 254/9 R; 267/160

[56] References Cited

U.S. PATENT DOCUMENTS

| | | | |
|---|---|---|---|
| Re. 27,261 | 12/1971 | Bromell et al. | 114/264 |
| 1,781,063 | 11/1930 | Jessen | 405/290 X |
| 2,517,612 | 8/1950 | Varian . | |
| 2,842,939 | 7/1958 | D'Auriac | 405/214 |
| 3,472,032 | 10/1969 | Howard | 114/264 X |
| 3,714,995 | 2/1973 | Hanes et al. | 175/5 |
| 3,721,293 | 3/1973 | Ahlstone et al. | 175/5 X |
| 3,743,249 | 7/1973 | van Daalen | 175/7 X |
| 3,749,367 | 7/1973 | Joubert et al. . | |
| 3,752,432 | 8/1973 | Lowe | 248/588 X |
| 3,791,628 | 2/1974 | Burns et al. . | |
| 3,794,125 | 2/1974 | Nelson . | |
| 3,996,753 | 12/1976 | Lubojatsky et al. | 405/296 X |
| 4,362,438 | 12/1982 | Spink | 405/195 |
| 4,364,323 | 12/1982 | Stevenson | 405/195 X |
| 4,379,657 | 4/1983 | Widiner et al. | 405/195 |
| 4,449,854 | 5/1984 | Nayler . | |
| 4,511,115 | 4/1985 | Ludwigsen . | |
| 4,576,517 | 3/1986 | McCann et al. | 405/195 |
| 4,662,786 | 5/1987 | Cherbonnier | 405/195 |

FOREIGN PATENT DOCUMENTS

| | | | |
|---|---|---|---|
| 709400 | 8/1941 | Fed. Rep. of Germany . | |
| 1920696 | 4/1978 | Fed. Rep. of Germany | 248/588 |
| 606919 | 5/1978 | U.S.S.R. | 405/203 |
| 1511696 | 5/1978 | United Kingdom . | |
| 2168944A | 7/1986 | United Kingdom . | |

*Primary Examiner*—David H. Corbin

*Attorney, Agent, or Firm*—William W. Haefliger

[57] ABSTRACT

A dynamic load compensation system comprises:

(a) first structure to receive applied loading, and subject to displacement generally in the direction of load exertion, (b) a base speed from said structure, and (c) means including pairs of generally parallel fluid actuator members pivotally connected to said base and to said structure for supporting said structure on the base, said members acting to resist said displacement of said structure characterized in that said base may move relatively toward and away from said structure while said loading continues to be applied to said structure.

19 Claims, 8 Drawing Sheets

LOAD COMPENSATING SYSTEM

BACKGROUND OF THE INVENTION

This application is a continuation in part of my prior application Ser. No. 783,679, filed Oct. 3, 1985, now U.S. Pat. No. 4,662,786.

This invention relates generally to motion compensation, and more particularly to improvements in heavy duty compensating devices making them simpler, more effective and reliable.

There is need for simple, effective, reliable, heavy duty, motion and load compensating equipment. For example, helicopter landing pads should support a predetermined load and dissipate additional loading, to compensate for and nullify additional forces exerted as a result of deck "heave", on a vessel. A desirable "shock deck" should also compensate for a "hot" landing or inadvertent rapid descent rate, of the helicopter, and which might otherwise adversely affect the structural integrity of the deck support structure.

In the case of a floating offshore drilling vessel, it cannot inherently provide a constantly stable platform as related to the sub-sea well head. In this regard, a stable reference is required for landing and retrieving of wellhead and blow out prevention equipment, control of string weight on the drill bit in the hole, landing of casing and liner, coring, well logging and fishing. There is need for nullification of the effects of rig/platform heave in response to swelling seas, and for compensation apparatus that will maintain a predetermined lifting force.

Prior Drill String Compensators (D.S.C's) sometimes called heave compensators, are of two types:

1. Block mounted, or
2. Crown mounted

Block mounted compensators, substantially increase the weight applied to the draw works, require precise alignment of derrick track and dollys, and represent a substantial change in the deck loading arm by their movement up and down the derrick. Crown mounted compensators, overcome these major disadvantages, but still add a significant weight to the crown of the derrick. These two methods share some common disadvantages:

1. Stroke/compensation length is equal to rod length or must incorporate chains and sheaves which add additional wear/failure areas.
2. Rig heave compensation causes compression or expansion of compressed air, which in turn causes an inverse reaction in the compensating force applied.

SUMMARY OF THE INVENTION

It is a major object of the invention to provide a compensation system meeting the need as referred to, and overcoming disadvantages of prior compensators. Basically, the system of the invention comprises:

(a) first structure to receive applied loading, and subject to displacement generally in the direction of load exertion, (b) a base spaced from said structure, and (c) means including pairs of generally parallel fluid actuator members pivotally connected to said base and to said structure for supporting said structure on the base, said members acting to resist the displacement of such structure characterized in that the base may move relatively toward and away from the structure while loading continues to be applied to the structure.

Typically, the actuator members of each pair are interconnected along their lengths between pivotal connections to the base and said structure; in one form of the invention the actuator members of each pair are rigidly interconnected by interconnection means along their lengths between the pivotal connection to the base and said structure; and in another form;, the actuator members of each pair are pivotally interconnected by connector members, at locations along their lengths between the pivotal connections to the base and said structure. Further, multiple pairs of actuator are typically provided; and in one form of the invention there are two pairs of said actuator members, at opposite sides of the path of said structure displacement; and in another form of the invention there are four pairs of said actuator members located at approximately equal intervals about the path of said structure displacement.

Further, each actuator typically includes a longitudinally extending piston chamber, a piston movable longitudinally therein, there being compressed gas in a first portion of the chamber at one side of the piston and against which the piston is urged by loading exerted by said structure, and there being liquid in a second portion of the chamber at the opposite side of the piston, and including flow passing means to pass liquid from said second portion of the chamber in response to movement of the piston toward said second portion of the chamber.

Typically, side load resisting clevis structures provide the pivotal connection to the base and said first structure; and when the two members of a pair have pivoted link interconnection, the two clevis connections to the base and/or first structure, for the two actuators, have spaced parallel pivot axes, and when the two members of a pair have rigid interconnection, the two clevis connections to the base and/or first structure, for the two actuators, have coaxial pivot axes.

Further, the invention is applicable to relatively movable base and first structure systems, as for example helicopter landing platforms and floating well derricks, whereby as the platform or first structure heaves upwardly in response to a rising sea, the base moves upwardly relative to the platform which substantially retains its elevation. A crown block may be carried or suspended by the first structure, and adjustable sheaves. pass lines to the crown block, as will appear.

Additional advantages of the invention includes:

(a) Compression versus force applied is at an exponential rate rather than linear. This exponential increase is absorbed by an inverse exponential mechanical displacement, which eliminates any change in lifting force.

(b) Utilization of this mechanical displacement eliminates the need for high pressure piping or bottles.

(c) The reduced amount of air required makes it very advantageous to use nitrogen as the gas medium, and allows a standard nitrogen generator to be used to charge the system, for safety.

(d) The system significantly increases the effectiveness of the compensation while reducing overall weight, cost of materials and cost of construction.

(e) Provision of a derrick upper end construction that provides increased strength and stability, as for the crown positioned compensator.

These and other objects and advantages of the invention, as well as the details of an illustrative embodiment, will be more fully understood from the following specification and drawings, in which:

DRAWING DESCRIPTION

FIG. 1*a* is a side elevation showing a pair of interconnected actuators;

FIG. 1*b* is a top plan view showing a pair of interconnected actuators;

Figure 13:
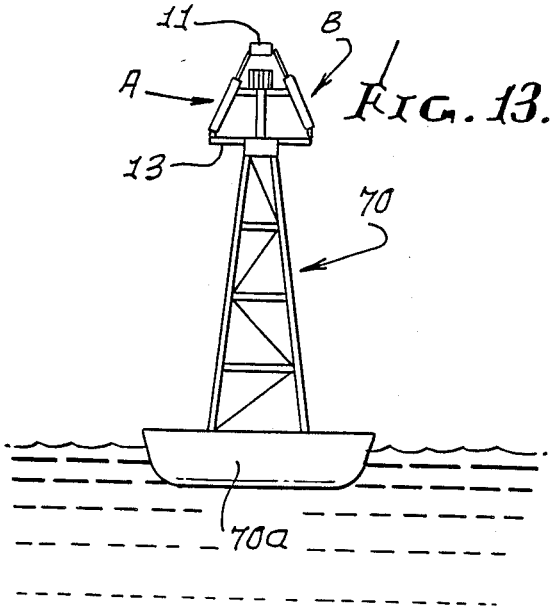
Figure 6A:
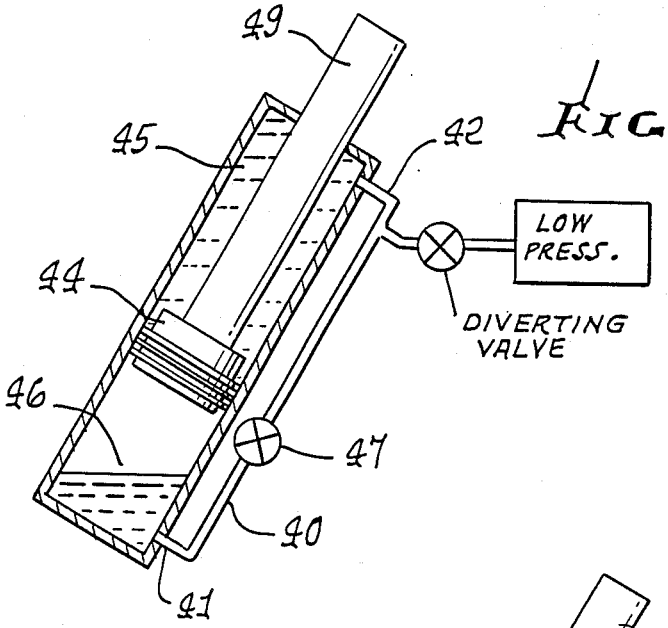
Figure 6B:
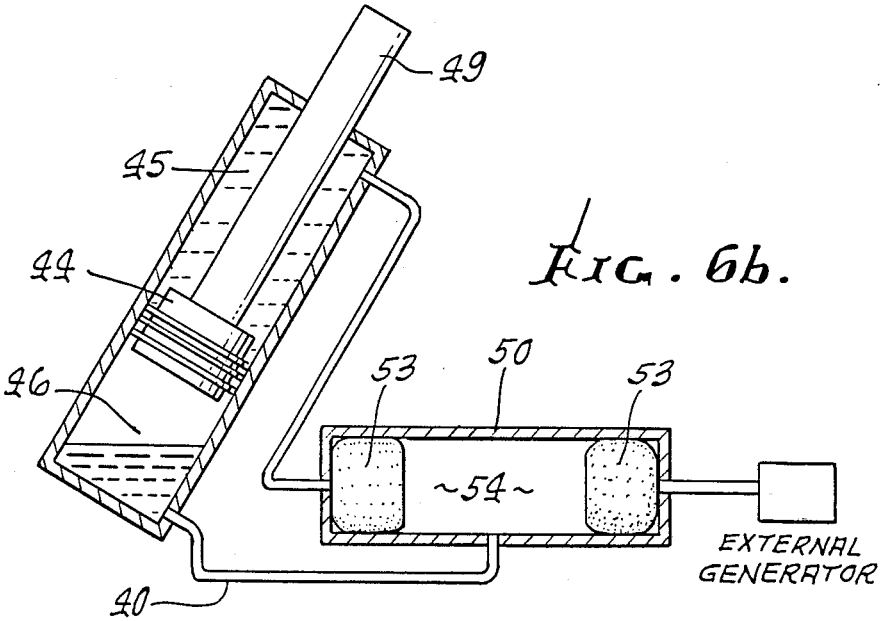
Figure 7:
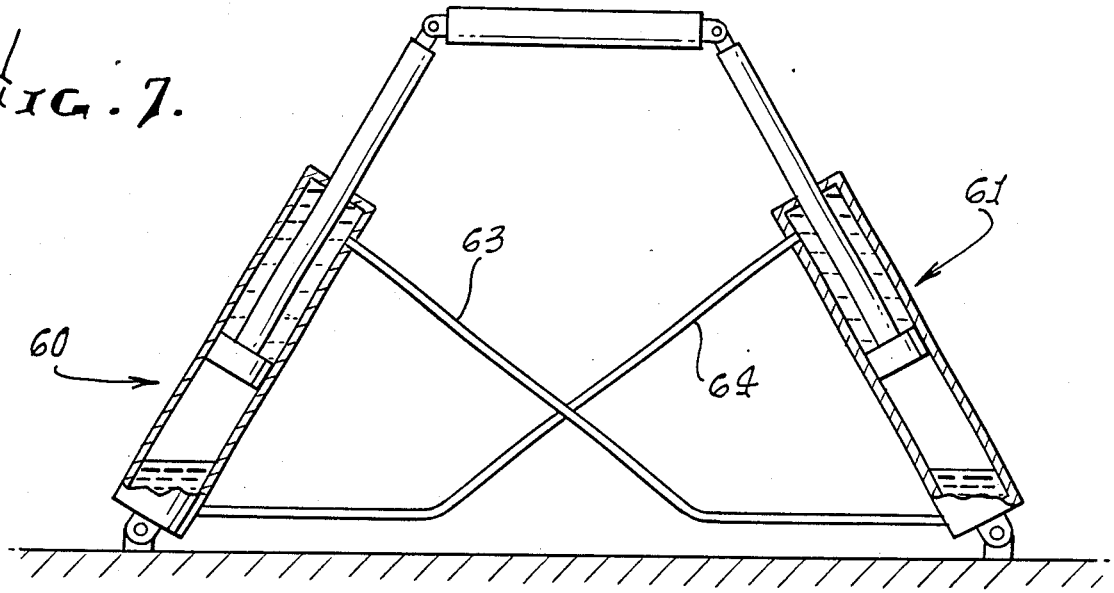
Figure 8A:
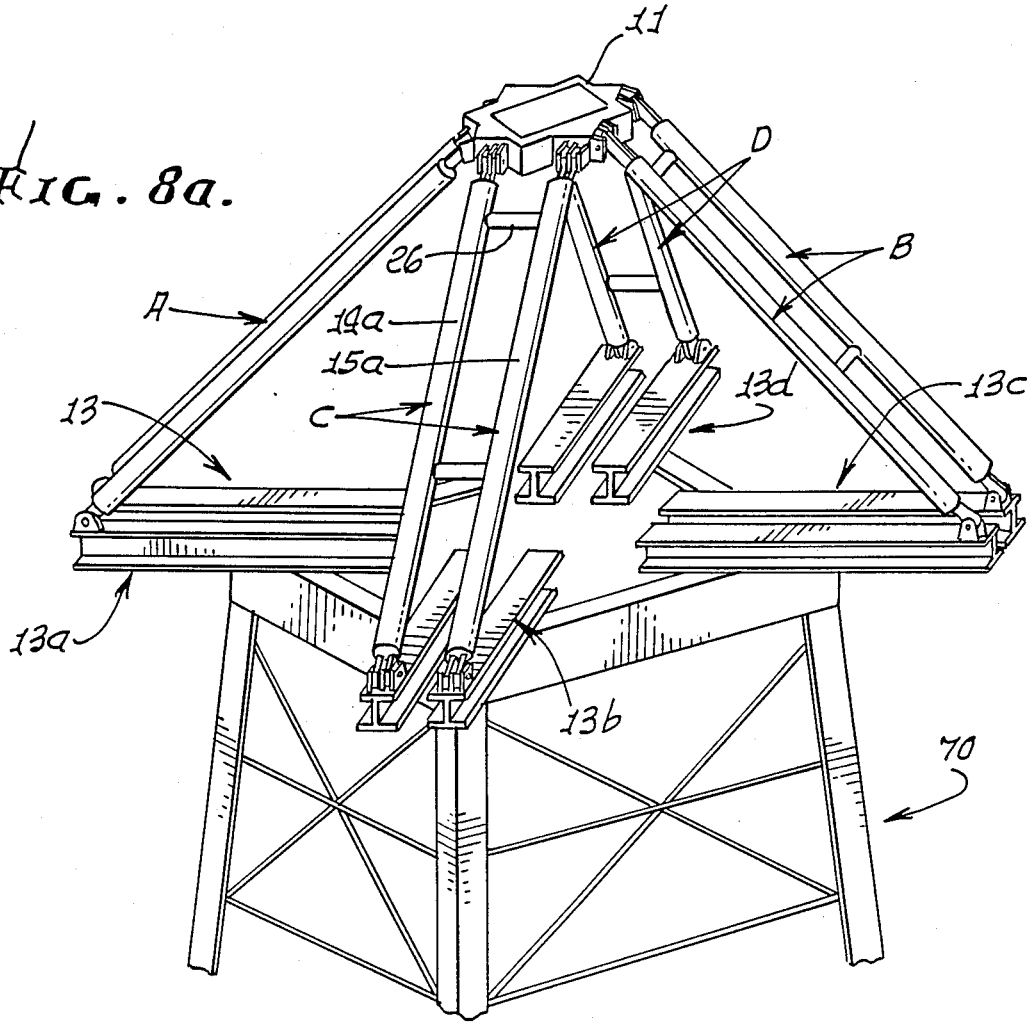
Figure 8B:
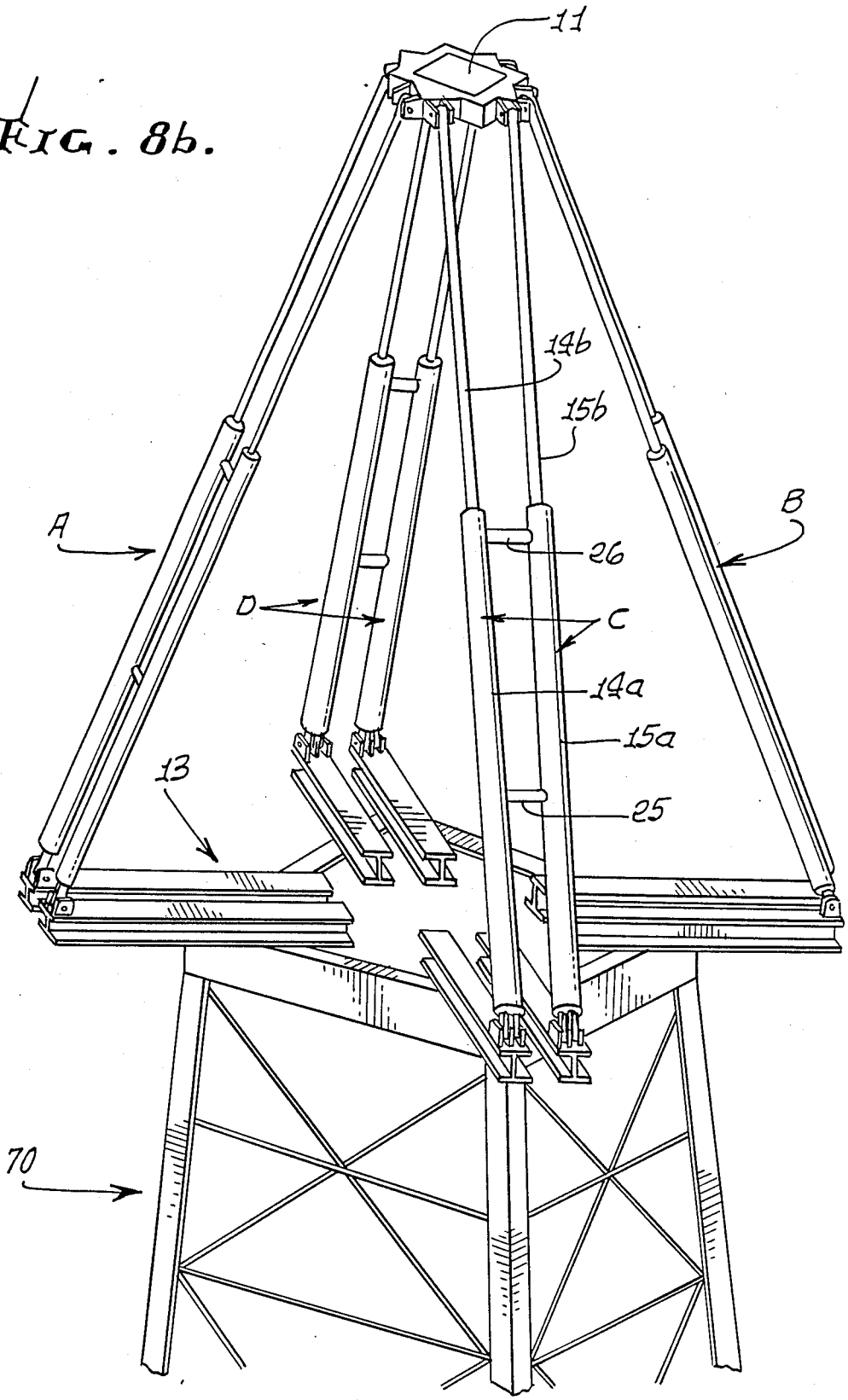
Figure 9:
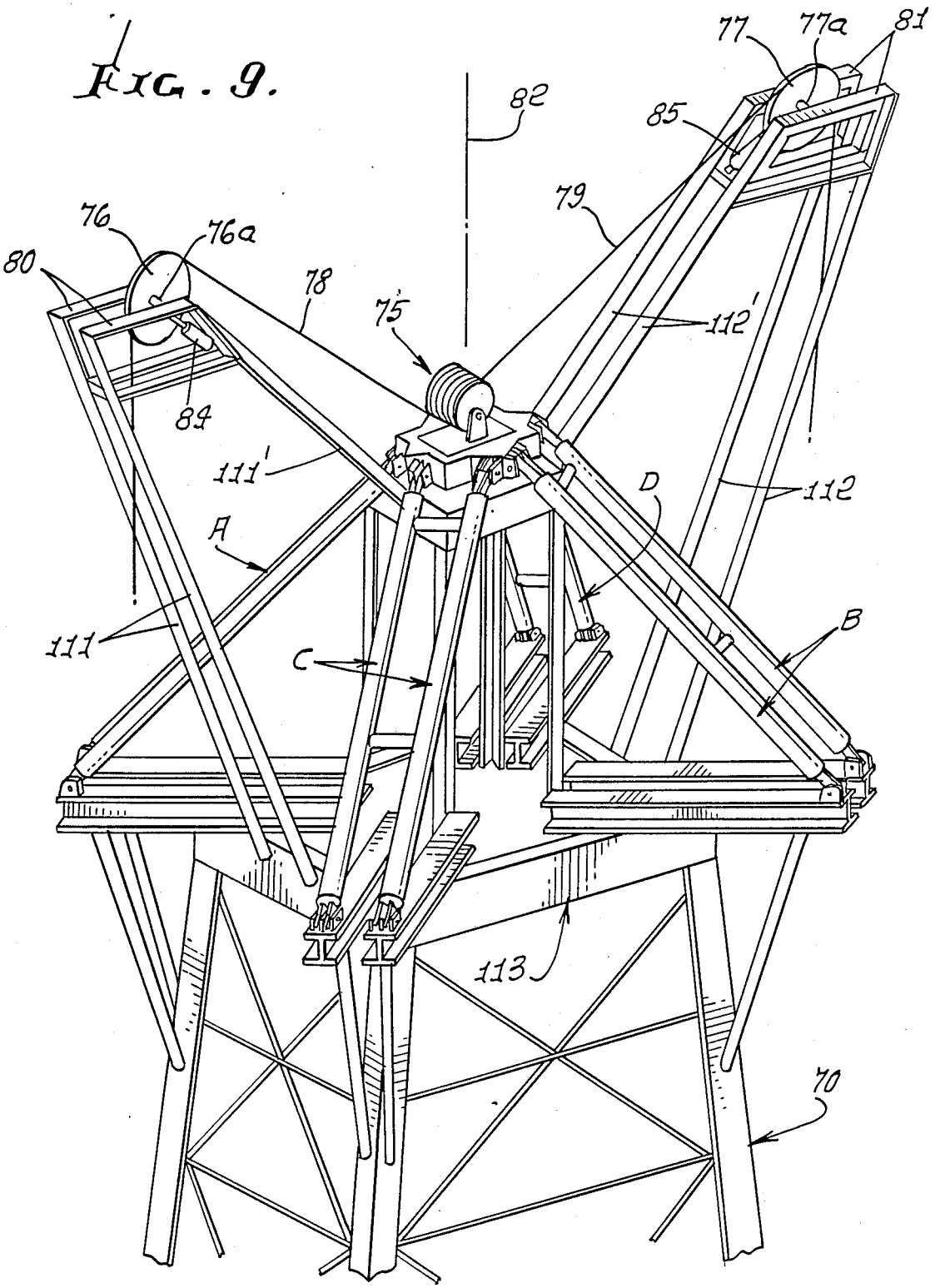
Figure 10:
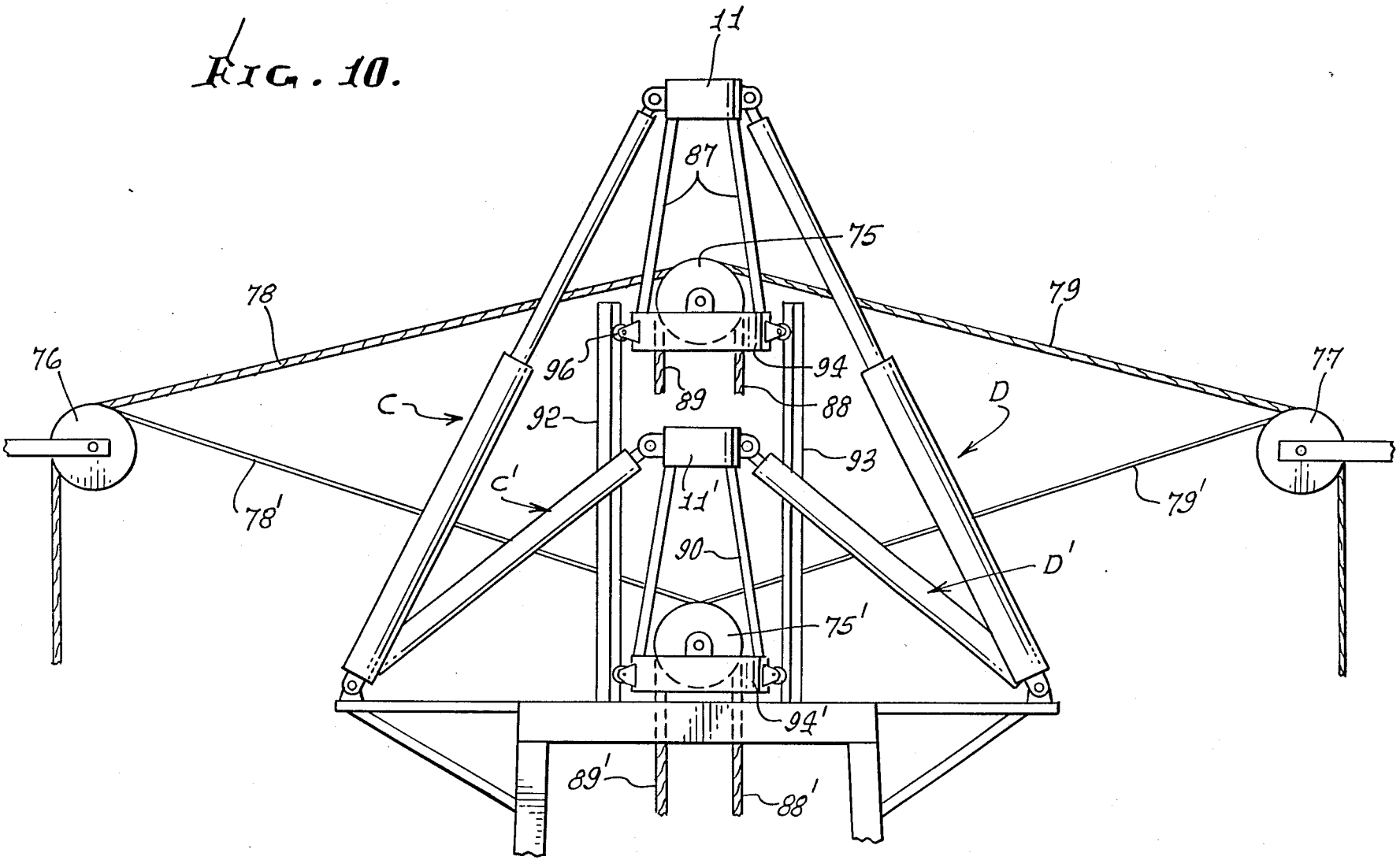
Figure 11:
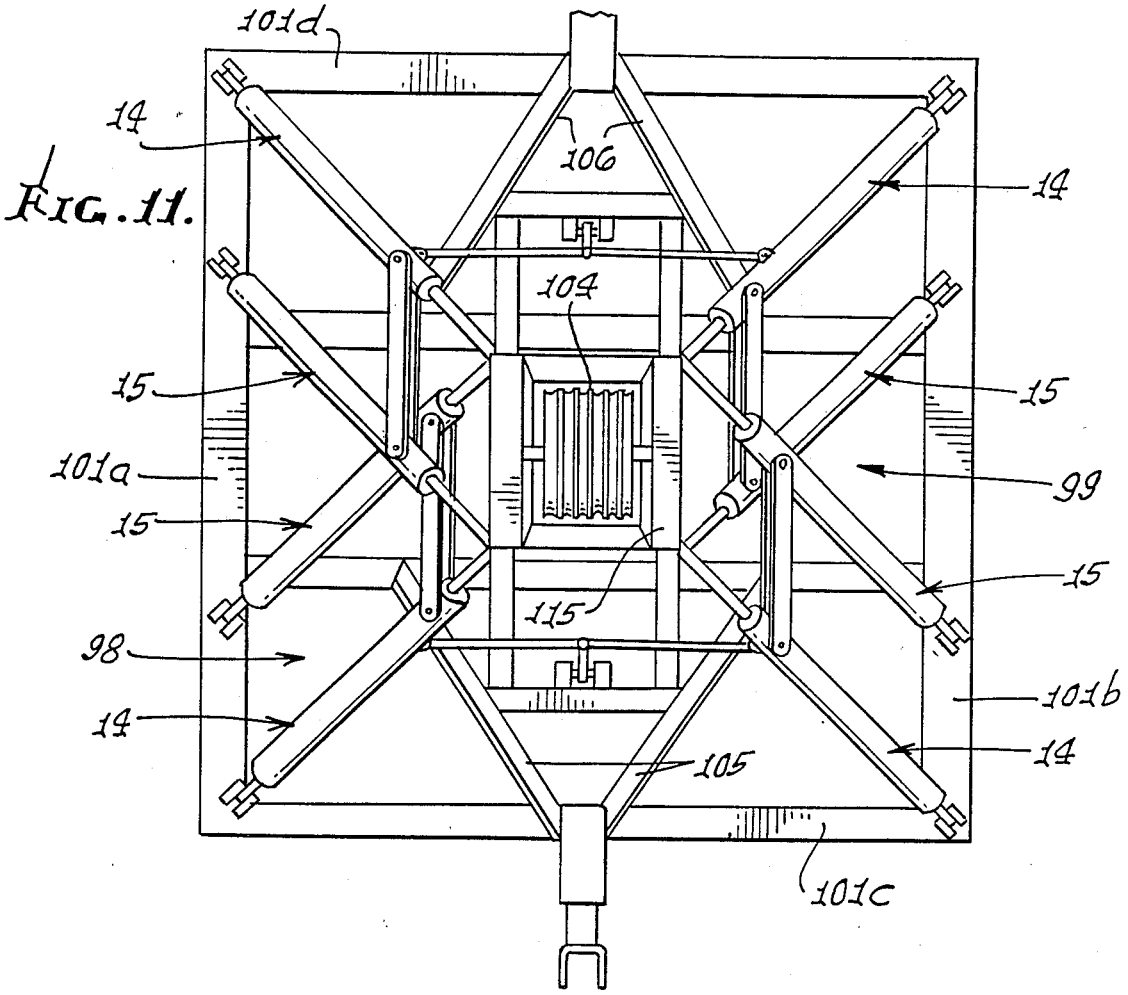
Figure 12:
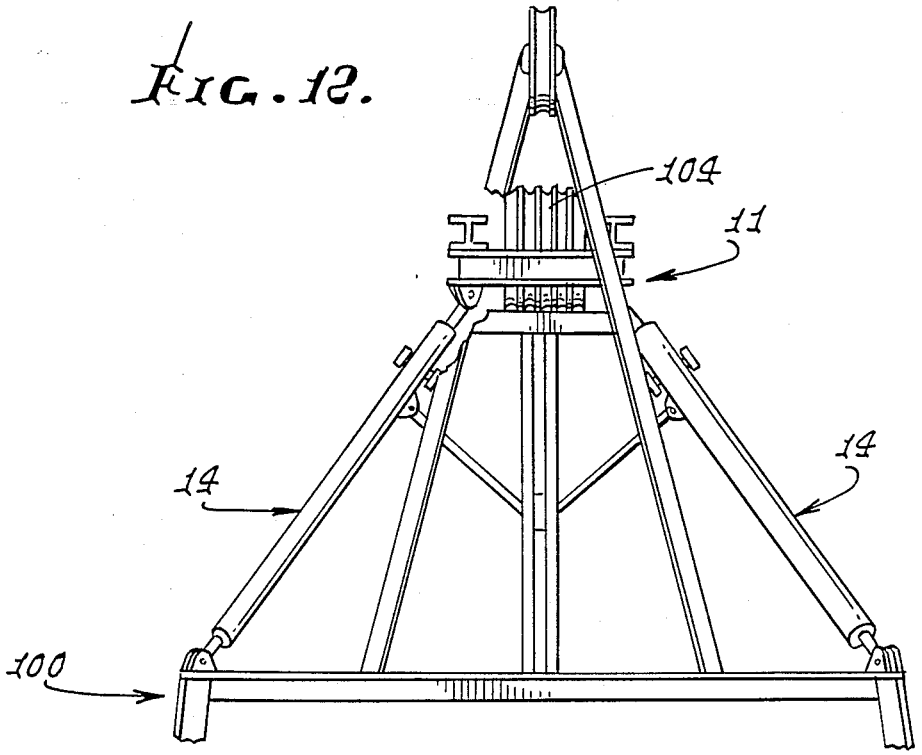

FIG. 6*a* and 6*b* are elevations showing actuator fluid interconnections,

FIG. 7 is a modified view showing actuator fluid interconnections;

FIGS. 8*a* and 8*b* are perspectives showing application of the invention to a well derrick;

FIG. 9 is a view like FIGS. 8*a* and 8*b*, showing a modification;

FIG. 10 is an elevation showing a further modifications, applying the invention to a well derrick;

FIGS. 11 and 12 are plan and elevational views showing a further modification,

FIG. 13 shows a derrick supported on a drilling vessel; and

Figure 1A:
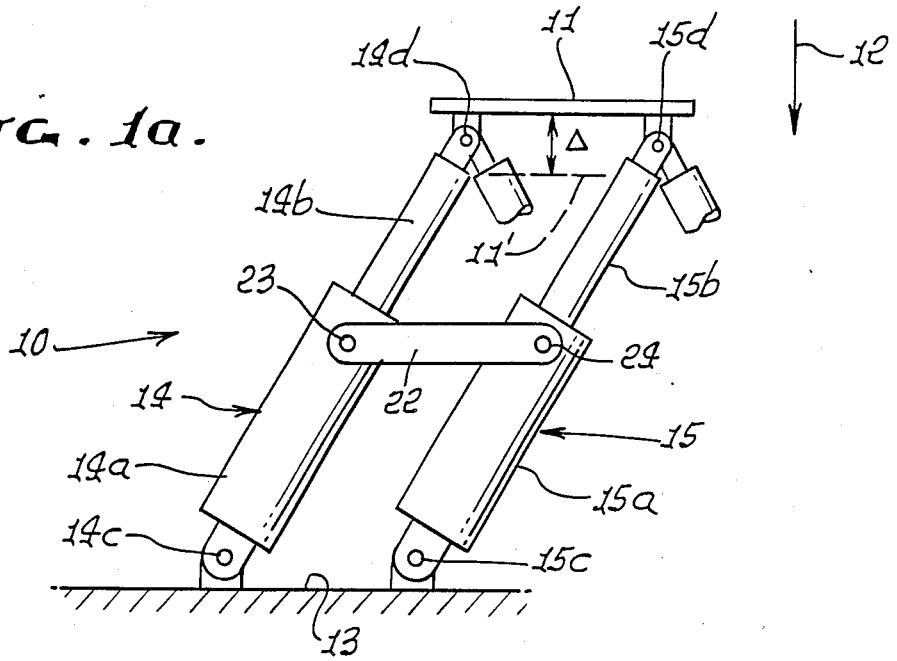
Figure 1B:
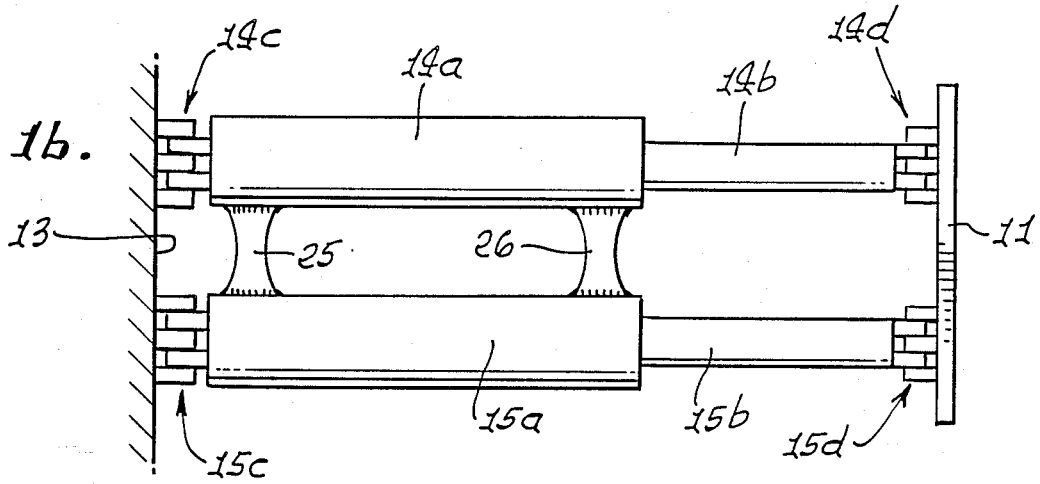
Figure 14:
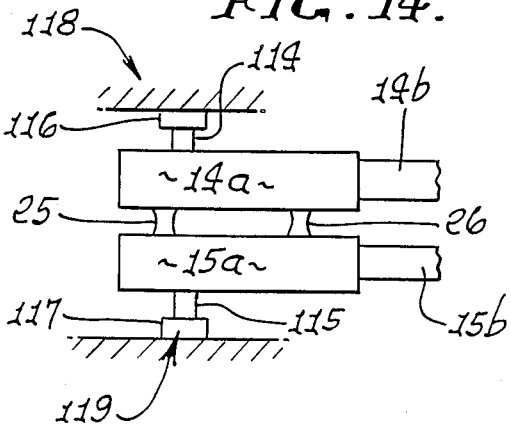

FIG. 14 is like FIG. 1*b*, and shows a modification.

DETAILED DESCRIPTION

Referring first to FIG. 1*a*, the illustrated dynamic load compensation system 10 comprises a first structure 11 to receive applied loading indicated by force arrow 12, and subject to displacement as at Δ generally in the direction of applied loading, i.e. direction of arrow 12, and to a level 11'. Also provided is a base 13 spaced from first structure 11 and to which the loading is to be transferred. Finally, means is provided to include at least one pair of generally parallel fluid actuator members 14 and 15 pivotally connected to the structure 11 and base 13, as in the parallelogram relation illustrated; and such members 14 and 15 consequently act to resist the displacement Δ characterized in that the base 13 may move relatively toward and away from the structure 11 while loading continues to be applied to structure 11, i.e. the latter continues to support the load. For example, base 13 may move vertically toward and away from structure 11, but does not move laterally relative thereto, and/or structure 11 may move vertically toward and away from structure 13, but does not move laterally relative thereto. Thus, support 11 may represent a helicopter landing pad on a base such as floating ship, and support 11 may represent a crown block on a well derrick which is in turn supported on a floating ship.

Figure 2:
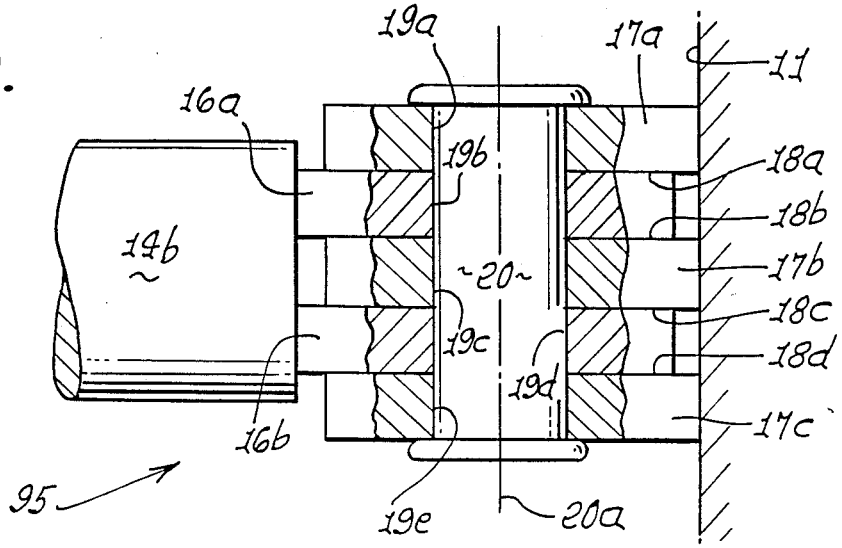
FIG. 2 is an enlarged plan view showing a double clevis construction.

In accordance with an important aspect of the invention, the members 14 and 15 are fluid actuators having cylinders 14*a* and 15*a* and piston plungers 14*b* and 15*b*, compressible fluid such as gas (nitrogen) contained by the cylinders is acting against the plunger pistons. The members 14 and 15 extend in parallel relation, and their connections 14*c* and 14*d*, and 15*c* and 15*d* to the elements 11 and 13 are such as to resist side loading in directions normal to the plane of FIG. 1*a*. A typical such connection is a clevis means 95 shown in FIG. 2, rod 14*b* having two laterally spaced supports 16*a* and 16*b* integrally attached to its end, and structure 11 having three laterally spaced supports 17*a*, 17*b* and 17*c* attached thereto. Supports 16*a* and 16*b* extend between supports 17*a*, 17*b*, and 17*c*, to have sliding relation with their sides at loci 18*a*, 18*b*, 18*c* and 18*d*; and a pivot pin 20 extends through openings 19*a*, 19*b*, 19*c*, 19*d* and 19*e* in the supports. Loci 18*a*–18*d* define parallel planes relative to which the axes of rod 14*b* and cylinder 14*a* remain parallel during pivoting, whereby, relative lateral movement of the structure 11 and base 13 is blocked as in the lateral direction of pin 20. If multiple pairs of such actuators are provided so that the axes of pins 20 of one pair are at an angle (as for example normal) to the axes of the pins of a second pair, relative displacement of structure 11 and base 13 in all lateral directions is blocked. This effect is enhanced by providing an interconnection or interconnections between the members 14 and 15 along their lengths between the pivot connections. See for example the connection link 22 between the cylinders 14*a* and 14*b* and pivotally connected to the latter at 23 and 24, the axes of such pivots being parallel to the axis 20*a* of pin 20; also the link is parallelogram connected to the actuators, as related to the pivoted connections of the latter to 11 and 13. Note that pin axes of supports 14*c* and 15*c* are spaced apart, and the pin axes of supports 14*d* and 15*d* are spaced apart, laterally.

Even further enhancement of lateral displacement resistance effect is obtained by rigidly interconnecting the members 14 and 15 along their lengths. See for example the plan view of FIG. 1*a*, wherein the elements are the same as in FIG. 1*b*, and correspondingly numbered, except for the rigid connections 25 and 26 between the cylinders 14*a* and 15*a*; also the pin axes of supports 14*c* and 15*c* are co-axial; and pin axes of supports 14*d* and 15*d* are co-axial. The parallelogram design also resists torsional bending forces, as by putting one actuator in tension and the other in compression. The double clevis design of FIG. 2 accomplishes a similar task, in that the two fixed hinges or pivots convert a free end bending moment section modulus to a fixed end section modulus. For example, torsional bending force places one clevis support 16*a* in tension, and the other clevis support 16*b* in compression as respects FIG. 2.

Figure 3:
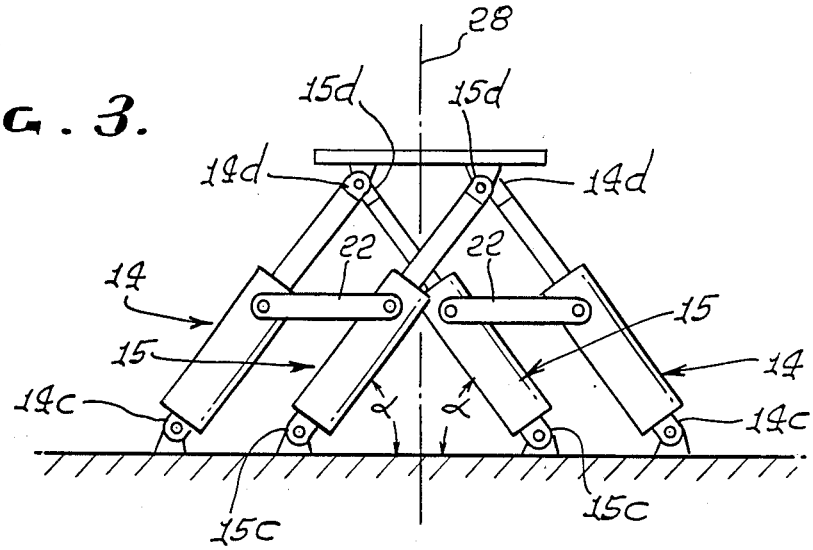
FIGS. 3 and 4 are elevations showing multiple pairs of actuators.

The system shown in FIG. 3 comprises two pairs of such actuators 14 and 15 connected between a base 13 and a structure 11, as in FIG. 1*a*. The pivots 14*c* and 15*c* of one pair are at one side of axis 28, and the pivots 14*c* and 15*c* of the other pair are at the opposite side of axis 28. The pivot 14*d* of actuator 14 of one pair is common to the pivot 15*d* of actuator 15 of the other pair, and the pivot 15*d* of the actuator 15 of the one pair is common to the pivot 14*d* of actuator 14 of the other pair, as shown. Thus, actuators 14 and 15 of the left pair are axially directed rightwardly and upwardly at angle $\alpha$ to the base; and actuators 14 and 15 of the right pair are axially directed leftwardly and upwardly at angle $\alpha$ to the base. Clevis pivot connections to 11 and 13 remain the same as in FIGS. 1*a* and 2; and all pivot connections have parallel axes. Note links 22, the same as in FIG. 1*a*.

Figure 4:
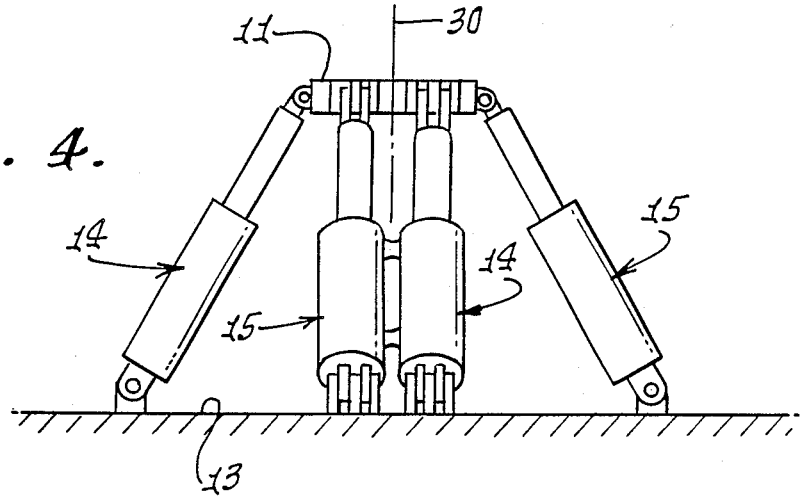

In FIG. 4 the construction incorporates four pairs of actuator members of the configuration as seen in FIG. 1*b*. The four pairs are spaced about a vertical axis 30; two of the four pairs are located at opposite sides of the axis 30 at 3 and 9 o'clock position; and the remaining two of the four pair are located at opposite sides of the axis 30, at 6 and 12 o'clock positions.

Figure 5:
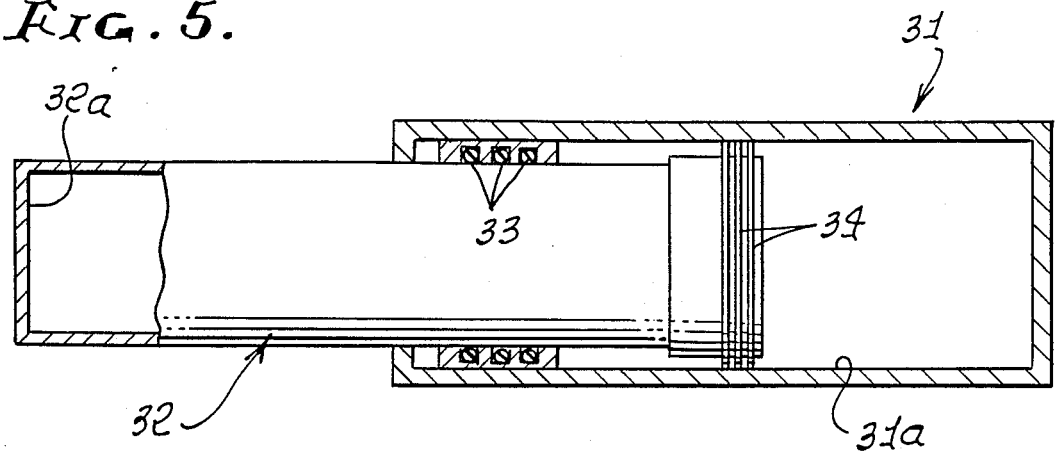
FIG. 5 is an elevation showing the construction of an actuator.

In both FIGS. 3 and 4, the multiple pairs of actuators act to reinforce one another, in opposing lateral forces. Typically, the axes of the actuators in each of FIGS. 3 and 4 share a common apex, allowing for a single interconnecting platform structure 11. Also the cylinders are mounted diagonally to oppose a vertical load. This diagonal mount causes the angle of the cylinder ($\angle\alpha$) to decrease as the elevation of the apex decreases. The resultant pressure increase in the cylinder is compensated for by the increased force required (by virtue of decrease in $\angle\alpha$) of the diagonal support in relation to the vertical load. The percent of compensation achieved is determined by the span and limits of the degree of motion ($\angle\alpha$). The cylinders utilized typically have hollow rods for the purpose of reduced weight and increased internal volume. Pressure seals are installed on the rod ends to create an effective piston area equal to the cylinder I.D., as seen in FIG. 5.

Note cylinder 31 having bore 31*a*, hollow rod 32, with fluid pressure exerted against piston face 32*a*; load bearing seals at 33, and piston seals at 34.

To further reduce excess variation which may be the result of an "other than optimum" angular span, the compression area volume is reduced as the rod extends. The most effective method to reduce internal volume is to use oil displaced by the "effective piston" to be introduced into the compression area either internally as in FIG. 6*a* or in an external reservoir as in FIG. 6*b*.

In FIG. 6*a*, a transfer duct 40 is connected at 41 to the cylinder below the piston level, and at 42 to the cylinder 43 above the level of piston 44, and liquid transfers from space 45 in the cylinder above the piston and about rod 49, to space 46 in the cylinder below the piston level, as the rod extends. Gas pressure in space 46, drives the liquid back to space 45, as the rod retracts. Typically, although this method reduces the "effective piston" area to that of the rod O.D. are, the corresponding increase in pressure required increases the volume to pressure ratio (i.e. the cylinder volume required for a 12" piston is now based on and I.D. of 14").

Further advantages of this feature are that:

1. the escape of the oil from this rod is regulated by the orifice size which will prevent excessive acceleration (orifice at 42);
2. the oil passage may be blocked by means of a valve which would stop further movement of the rod; (see valve 47); and
3. relieving pressure from the oil by means of a diverter valve to an additional low pressure reservoir increases the effective piston area/force for special contingencies with no increase in gas pressure.

In FIG. 6*b*, the construction is the same, except that an exterior reservoir 50 is connected into duct 40. See oil containing bladders 53, and gas space 54 between the bladders.

In FIG. 4, four pairs of cylinders are mounted to form two isosceles triangles with their base line at 90° to each and a common effective apex. In FIG. 7, referred to above, the elements 60, 61, 63 and 64 are as shown.

In FIGS. 8*a* and 8*b*, the four pairs of actuators, as in FIG. 4, are applied to a well derrick 70, near its top, to support a crown block platform structure 11. Beams 13*a*–13*d* represent the base 13, supported at the top of the derrick. In FIG. 8*a* the rods are retracted, and in FIG. 8*b* they are extended. The four pairs of actuators are indicated at A, B, C and D. See also FIG. 13, the derrick 70 supported by floating vessel 70*a*.

In FIG. 9, the construction is the same as in FIGS. 8*a* and 8*b*; however, the crown block appears at 75, and sheaves 76 and 77 are adapted to support control lines 78 and 79 to the crown block. The sheave axles 76*a* and 77*a* are supported at 80 and 81 for movement toward and away from the vertical central axis 82, to compensate for extension and retraction of the actuators. Sheave shifting actuators appear at 84 and 85. A similar arrangement appears in FIG. 10, except that the crown block 75 is suspended at 87 from structure 11. Well equipment is suspended via lines 88 and 89, by the block 75. Also, another platform structure 11' is supported by base 13, via additional pairs of actuators indicated at C' and D', and of the FIG. 4 type. See also the second suspended crown block 75', a suspension indicated at 90. Lines 88' and 89' also suspend well equipment. Lines 78' and 79' extend from sheaves 76 and 77 to block 75'. Vertical guides are shown at 92 and 93 to guide up and down movement of the supports 94 and 94' for blocks 75 and 75'. Anti friction rollers 96 carried by 94 and 94' ride up and down in guide grooves 97 in 92 and 93. Sheave support structure appears at 111, 111', 112 and 112' in FIGS. 9 and 10. Structures 111' and 112' may extend to base beams 113, as do structures 111 and 112.

FIGS. 11 and 12 show two sets 98 and 99 of actuators of the type seen in FIG. 3, applied to a well derrick 100, near its top, to support a crown block platform structure 11. Beams 101*a*–104*a* represent the base 13, supported at the top of the derrick. The operation is the same previously described and the supported crown block is shown at 104, having several annular pulley grooves for the line or lines that in turn support the well equipment. Control line sheaves 76 and 77 are arranged as in FIG. 9. Supports for the sheaves appear at 105 and 106.

In FIG. 14, the structure is the same as in FIG. 1*b*, and carries the same numerals, except that connections 14*c* and 15*c* are omitted; instead trunnions 114 and 115 are integral with the two cylinders, and rotatable in bearings 116 and 117 on fixed support structures 118 and 119. Thus, side loads are resisted, and axial loading is transmitted to 118 and 119.

This continuation-in-part application incorporates by reference all of parent application Ser. No. 783,679, now U.S. Pat. No. 4,662,786 to issue May 5, 1987.

I claim:

1: In a dynamic load compensating system, the combination comprising (a) first structure to receive applied loading, and subject to displacement along a longitudinal path generally in the direction of load exertion, (b) a base spaced from said structure, and (c) means including pairs of generally parallel fluid actuator members pivotally connected to said base and to said structure for supporting said structure on the base, said members acting to resist said displacement of said structure characterized in that said base may move relatively toward and away from said structures while said loading continues to be applied to said structure, (d) the actuator members of each pair being interconnected along their lengths between their pivotal connections to the base and said first structure so as to extend in and remain in side by side parallel relation during actuation, said actuators including pistons and cylinders, the cylinders being directly interconnected proximate ends thereof from which the pistons emerge, (e) there being two pairs of said actuator members, respectively at opposite sides of the path of said structure displacement, the actuators of each pair having like inclination to said path, and being inclined from vertical, (f) and including side load resisting clevis devices pivotally connecting each of actuators at its opposite ends respectively to said structure and to said base.

2. The combination of claim 1 wherein the actuator members of each pair are rigidly interconnected by interconnection means along their lengths between the pivotal connection to the base and said structure.

3. The combination of claim 1 wherein there are four pairs of said actuator members located at approximately equal intervals about the path of said structure displacement.

4. The combination of claim 1 wherein each actuator includes a longitudinally extending piston chamber, and a piston movable longitudinally therein, there being compressed gas in a first portion of the chamber at one side of the piston and against which the piston is urged by loading exerted by said structure, and there being liquid in a second portion of the chamber at the opposite side of the piston, and including flow passing means to pass liquid from said second portion of the chamber in response to movement of the piston toward said second portion of the chamber.

5. The combination of claim 4 wherein said flow passing means is connected between said first and second portions of the chamber.

6. The combination of claim 4 including a pressure reservoir, and wherein said flow passing means is connected to said reservoir to pass liquid thereto.

7. The combination of claim 1 including a well derrick on which said structure is supported.

8. The combination of claim 7 including a floating offshore drilling platform supporting said derrick, whereby as the platform heaves upwardly in response to a rising sea, the base moves upwardly relative to the platform which substantially retains its elevation.

9. The combination of claim 8 including a crown block carried by said structure, and a well pipe supporting line connected to said crown block to raise and lower the pipe, the crown block being movable to extend or shorten the line effective length in response to said upward or downward displacement, respectively, of the drilling platform, whereby the crown block maintains its approximate elevation relative to the sea bed.

10. The combination of claim 9 including a sheave on the derrick offset from the crown block and guidedly engaging said lines.

11. The combination of claim 10 including an actuator to shift the sheave laterally, to compensate for changes in elevation of the crown block, relative to the base.

12. The combination of claim 9 wherein the crown block is suspended by said structure via a mount for the block.

13. The combination of claim 12 including guide means on the platform to guide vertical movement of the mount relative to the base.

14. The combination of claim 2 wherein there are pivotal connections of the actuator members to the base and which have a common axis; and there are pivotal connections of the actuator members to said first structure, and which have a common axis.

15. The combination of claim 1 wherein there are pivotal connections of the actuator members to the base and which are spaced apart and parallel, there are pivotal connections of the actuator members to said first structure, and which are spaced apart and parallel.

16. The combination of claim 1 wherein at least one actuator includes a lower cylinder and an upper plunger projecting from the cylinder, liquid in the cylinder upper extent above the lower end of the plunger, gas in the cylinder lower extent below the level of the plunger, and a line communicating fluid pressure between said upper and lower extents.

17. The combination of claim 16 wherein the line directly connects said upper and lower extents.

18. The combination of claim 16 wherein the line indirectly connects said upper and lower extents, and via an auxiliary pressure chamber.

19. The combination of claim 16 including a control orifice in said line.

* * * * *